US006968142B2

(12) United States Patent
Arimitsu et al.

(10) Patent No.: US 6,968,142 B2
(45) Date of Patent: Nov. 22, 2005

(54) PROCESS CARTRIDGE AND IMAGE FORMING APPARATUS

(75) Inventors: Takeshi Arimitsu, Kanagawa (JP); Tachio Kawai, Kanagawa (JP); Hideki Maeshima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 10/367,805

(22) Filed: Feb. 19, 2003

(65) Prior Publication Data

US 2003/0156856 A1 Aug. 21, 2003

(30) Foreign Application Priority Data

Feb. 20, 2002 (JP) ..... 2002-043440

(51) Int. Cl.[7] ..... G03G 21/18
(52) U.S. Cl. ..... 399/114; 399/111
(58) Field of Search ..... 399/111, 114, 399/299

(56) References Cited

U.S. PATENT DOCUMENTS

| | | | | |
|---|---|---|---|---|
| 4,462,677 | A | 7/1984 | Onoda | 399/114 |
| 5,903,803 | A | 5/1999 | Kawai et al. | 399/116 |
| 5,946,531 | A | 8/1999 | Miura et al. | 399/111 |
| 6,002,896 | A | 12/1999 | Miyamoto et al. | 399/114 |
| 6,055,406 | A | 4/2000 | Kawai et al. | 399/360 |
| 6,061,538 | A | 5/2000 | Arimitsu et al. | 399/111 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,175,706 | B1 | 1/2001 | Watanabe et al. | 399/167 |
| 6,226,478 | B1 | 5/2001 | Watanabe et al. | 399/117 |
| 6,240,266 | B1 | 5/2001 | Watanabe et al. | 399/117 |
| 6,282,390 | B1 | 8/2001 | Miyabe et al. | 399/111 |
| 6,336,018 | B1 | 1/2002 | Kawai et al. | 399/117 |
| 6,351,620 | B1 | 2/2002 | Miyabe et al. | 399/111 |
| 6,381,430 | B1 | 4/2002 | Yokomori et al. | 399/119 |
| 6,453,135 | B1 * | 9/2002 | Sameshima et al. | 399/111 |
| 6,459,869 | B2 | 10/2002 | Nittani et al. | 399/111 |
| 6,463,232 | B1 | 10/2002 | Kawai et al. | 399/111 |
| 6,463,234 | B2 | 10/2002 | Arimitsu et al. | 399/113 |
| 6,480,687 | B1 | 11/2002 | Kawai et al. | 399/111 |
| 6,496,667 | B2 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 2002/0018668 | A1 | 2/2002 | Kanno et al. | 399/106 |
| 2002/0031368 | A1 | 3/2002 | Kanno et al. | 399/103 |
| 2002/0110388 | A1 | 8/2002 | Yokomori et al. | 399/167 |

FOREIGN PATENT DOCUMENTS

| | | | |
|---|---|---|---|
| JP | 2-158757 | 6/1990 | |
| JP | 7-120136 | 12/1995 | |
| JP | 11-352743 | 12/1999 | |
| JP | 2001142378 A * | 5/2001 | G03G/21/18 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A process cartridge detachably mountable to the main body of an image forming apparatus includes an electrophotographic photosensitive drum, at least one process device for acting on the drum, a cartridge frame holding the drum and the process device and exposing a portion of the drum, a shutter member provided for movement between a position to protect and a position to permit exposure the of the drum, and a shutter opening and closing link mechanism for moving the shutter member in operative association with the opening and closing operation of an openable and closable door when the process cartridge is mounted on the cartridge mounting portion of the main body of the image forming apparatus.

4 Claims, 10 Drawing Sheets

PROCESS CARTRIDGE AND IMAGE FORMING APPARATUS

BACKGROUND OF THE INVENTION

1. Field of the Invention

The invention relates to a process cartridge detachably mountable to an image forming apparatus, and to an image forming apparatus.

Herein, the image forming apparatus is an apparatus for forming an image on a recording medium such as recording paper, an OHP sheet, or cloth by the use of an electrophotographic image forming process, and covers, for example, an electrophotographic copying machine, an electrophotographic printer (such as an LED printer or a laser beam printer), a facsimile apparatus and a word processor.

The term "process cartridge" refers to an electrophotographic photosensitive drum and at least one process means for acting on the electrophotographic photosensitive drum integrally made into a cartridge detachably mountable to the main body of the image forming apparatus, or an electrophotographic photosensitive drum and at least developing means integrally made into a cartridge detachably mountable to the main body of the image forming apparatus. The process means include, in addition to developing means for supplying a developer to the electrophotographic photosensitive drum, charging means for charging the electrophotographic photosensitive drum, cleaning means for cleaning the electrophotographic photosensitive drum, etc.

2. Description of Related Art

In an image forming apparatus using the electrophotographic image forming process, selective exposure is effected on an electrophotographic photosensitive drum (hereinafter simply referred to also as the photosensitive drum) uniformly charged by charging means to thereby form a latent image on the surface of the photosensitive drum. The latent image is then visualized by a developer supplied from developing means, and thereafter the visualized image is transferred to a recording medium and further, the image is fixed by heat and pressure or the like to thereby effect image recording on the recording medium.

Also, any residual developer on the photosensitive drum after the transfer is removed by cleaning means, such as a cleaning blade and is contained as a removed developer in a cleaning container and therefore, the next development operation can be effected without any residual developer remaining on the surface of the photosensitive drum.

There has been adopted a process-cartridge system whereby of these portions concerned with image formation, the photosensitive drum and the process means (such as the charging means, the developing means and the cleaning means) for acting on the photosensitive drum are integrally made into a cartridge, which is made detachably mountable to the main body of the image forming apparatus. In this case, a user himself can effect the interchange of the cartridge to thereby interchange the photosensitive drum and consumables, such as the developer, without maintenance by a serviceman.

As the construction of an image forming apparatus for forming a multicolor (color) image by the use of such a process cartridge, a plurality of process cartridges containing developers of different colors therein are arranged in parallel to thereby constitute an image forming portion.

The process cartridge of this type may be left outside the main body of the image forming apparatus, or even if it is mounted in the main body of the image forming apparatus, the openable and closable door of the main body of the apparatus may sometimes be opened. In such a state, the photosensitive drum of the process cartridge may be exposed to external daylight and a characteristic thereof may deteriorate. Also, in case of the handling of the process cartridge outside the main body of the apparatus, the process cartridge may be damaged or foreign substances may adhere to the surface of the photosensitive drum. In order to eliminate the possibility of such deterioration or damage, there is provided a shutter member functioning as a protective member for protecting an exposed portion of the photosensitive drum, which is exposed out of a cartridge frame. When the process cartridge is outside the main body of the apparatus, the shutter member is closed, and when the process cartridge is mounted in the main body of the apparatus, the shutter member is opened to thereby expose the photosensitive drum, and during the operation of the image forming apparatus, it is retracted to a position in which it does not hamper image formation.

Now, in the image forming apparatus, in recent years, there has been a strong desire for the downsizing of the image forming apparatus on the part of the user, and there has been the problem that it is difficult to secure a great stroke for opening and closing the shutter member. There has further been a strong desire for the simple mounting and dismounting of the process cartridge, and it has been necessary to open and close the shutter member in operative association with the mounting and dismounting of the process cartridge. Moreover, the provision of a complicated mechanism on the opening and closing means of the shutter member leads to an increase in the cost of parts and the failure rate and therefore, it has been necessary for the opening and closing means to be a simple mechanism.

Further, in a full-color image forming apparatus of the in-line type, process cartridges of respective colors must be disposed in a limited space, and with regard also to the retraction position and retraction path of the shutter member of the photosensitive drum, the limitation in space is great. Also, not only in the full-color image forming apparatus, but also from the viewpoint of space saving, it is desirable that the space necessary for the retraction of the shutter member of the photosensitive drum be as small as possible.

SUMMARY OF THE INVENTION

So, it is an object of the present invention to provide a process cartridge and an image forming apparatus provided with a shutter member openable and closable in operative association with the mounting and dismounting of the process cartridge with respect to the main body of the image forming apparatus and retractable by a simple construction and a limited space.

It is another object of the present invention to provide a process cartridge and an image forming apparatus in which that portion of an electrophotographic photosensitive drum which is exposed out of a cartridge frame can be reliably protected by a shutter member.

It is another object of the present invention to provide a process cartridge and an image forming apparatus in which a shutter member can be retracted to a retraction position in a smaller space.

It is another object of the present invention to provide a process cartridge and an image forming apparatus in which a shutter member can be moved between a protection position and a retraction position in a smaller space.

It is another object of the present invention to provide a process cartridge and an image forming apparatus in which a shutter member can be reliably moved between a protection position and a retraction position.

It is another object of the present invention to provide a process cartridge detachably mountable to the main body of an image forming apparatus having a cartridge mounting portion for mounting the process cartridge thereon, and an openable and closable door, the process cartridge having an electrophotographic photosensitive drum, at least one process means for acting on the electrophotographic photosensitive drum, a cartridge frame holding the electrophotographic photosensitive drum and the process means and exposing a portion of the electrophotographic photosensitive drum therefrom, a shutter member provided for movement between a protection position in which it protects an exposed portion of the electrophotographic photosensitive drum that is capable of being exposed out of the cartridge frame and a retraction position in which it is retracted from the protection position to expose the exposed portion of the electrophotographic photosensitive drum that is exposed out of the cartridge frame, and a shutter opening and closing link mechanism for moving the shutter member in operative association with the opening and closing operation of the openable and closable door when the process cartridge is mounted on the cartridge mounting portion of the main body of the image forming apparatus, and an image forming apparatus on which the process cartridge is detachably mountable.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described with reference to the drawings.

Figure 1:
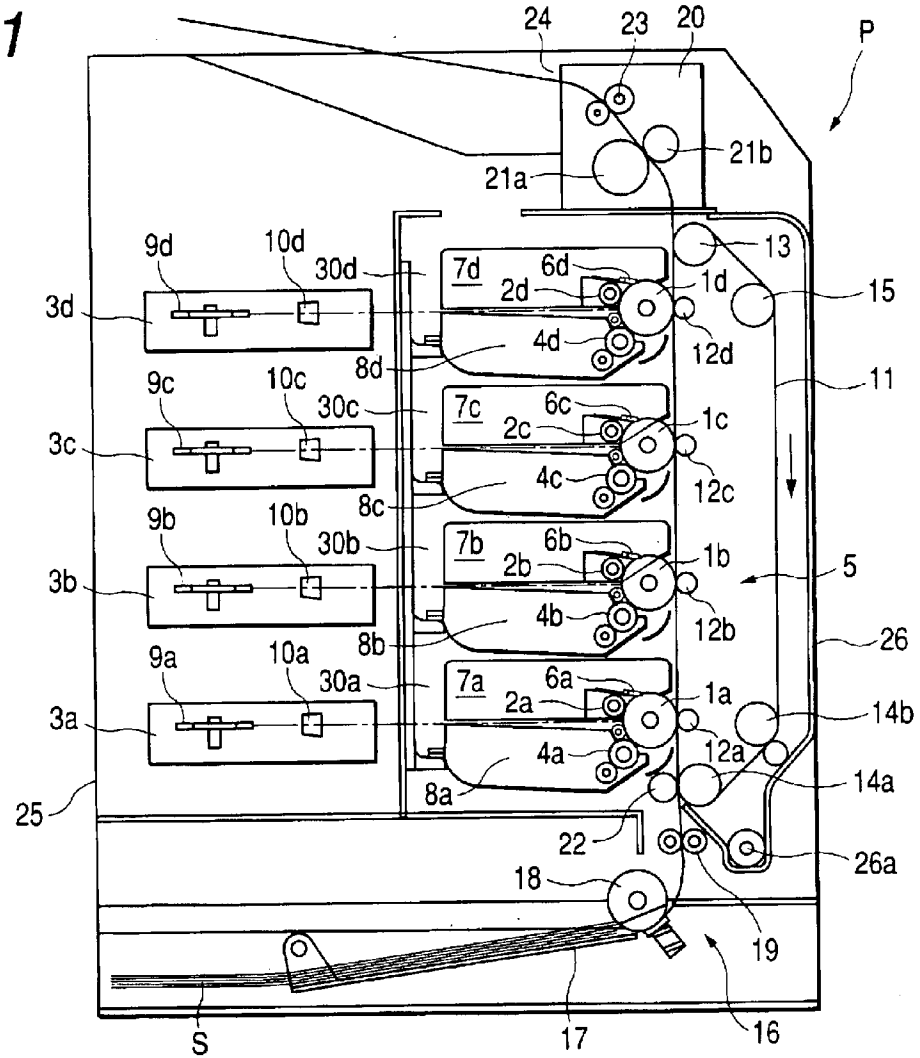
FIG. 1 is a cross-sectional view showing the general construction of a full-color laser beam printer which is an embodiment of the image forming apparatus of the present invention.

The general construction of an image forming apparatus according to the present invention and image formation thereby will first be schematically described with reference to FIG. 1. FIG. 1 is a cross-sectional view showing the general construction of a full-color laser beam printer which is an embodiment of the image forming apparatus of the present invention.

The image forming apparatus P shown in FIG. 1 is such that a plurality of (in FIG. 1, four) cartridge mounting portions (30*a*, 30*b*, 30*c*, 30*d*) for mounting thereon process cartridges (hereinafter simply referred to also as the cartridges) 7 (7*a*, 7*b*, 7*c*, 7*d*) provided with electrophotographic photosensitive drums (hereinafter simply referred to as the photosensitive drums) (1*a*, 1*b*, 1*c*, 1*d*), functioning as image bearing members, are juxtaposed in a vertical direction. In the respective process cartridges 7 (7*a*, 7*b*, 7*c*, 7*d*), the photosensitive drums (1*a*, 1*b*, 1*c*, 1*d*) are driven in a counterclockwise direction as viewed in FIG. 1 by driving means (not shown). Around the photosensitive drums (1*a*, 1*b*, 1*c*, 1*d*), there are disposed, in succession in accordance with the direction of rotation thereof, charging devices (2*a*, 2*b*, 2*c*, 2*d*) for uniformly charging the surfaces of the photosensitive drums (1*a*, 1*b*, 1*c*, 1*d*), scanner units (3*a*, 3*b*, 3*c*, 3*d*) for applying laser beams onto the photosensitive drums on the basis of image information to thereby form electrostatic latent images thereon, and developing devices (4*a*, 4*b*, 4*c*, 4*d*) for causing developers to adhere to the electrostatic latent images to thereby develop the electrostatic latent images. Also, there is disposed an electrostatic transfer device 5 for transferring the developer images on the photosensitive drums to a recording medium S. This electrostatic transfer device 5 has an electrostatic transport belt 11 and transfer rollers (12*a*, 12*b*, 12*c*, 12*d*). Also, there are disposed cleaning devices (6*a*, 6*b*, 6*c*, 6*d*) for removing any developers remaining on the surfaces of the photosensitive drums after the transfer.

The photosensitive drums (1*a*, 1*b*, 1*c*, 1*d*), the charging devices (2*a*, 2*b*, 2*c*, 2*d*), the developing devices (4*a*, 4*b*, 4*c*, 4*d*), the cleaning devices (6*a*, 6*b*, 6*c*, 6*d*) and developer containing portions (8*a*, 8*b*, 8*c*, 8*d*) are made integral with one another to thereby constitute the process cartridges 7 (7*a*, 7*b*, 7*c*, 7*d*). The construction of the process cartridges 7 is shown in detail in FIG. 4. These cartridges 7 (7*a*, 7*b*, 7*c*, 7*d*) are detachably mounted on the cartridge mounting portions (30*a*, 30*b*, 30*c*, 30*d*) of the main body 25 of the image forming apparatus (hereinafter simply referred to also as the main body of the apparatus). The scanner units (3*a*, 3*b*, 3*c*, 3*d*) are attached to the main body 25 of the apparatus so as to correspond to the cartridges 7 (7*a*, 7*b*, 7*c*, 7*d*) mounted on the cartridge mounting portions (30*a*, 30*b*, 30*c*, 30*d*).

The respective constructions will hereinafter be described in succession. The constructions of the respective cartridges 7 are schematically similar to one another.

Each of the photosensitive drums (1*a*, 1*b*, 1*c*, 1*d*) is comprised, for example, of an aluminum cylinder having a diameter of 30 mm and a photoconductive layer provided on the outer peripheral surface thereof. Each of the photosensitive drums has the opposite end portions of its drum shaft rotatably supported by support members such as bearings. A driving force from a driving motor (not shown) provided on the main body side of the apparatus is transmitted to one end portion of each of the photosensitive drums, whereby each of the photosensitive drums 1 is driven to rotate in a counterclockwise direction as viewed in FIG. 1.

As the charging devices (2*a*, 2*b*, 2*c*, 2*d*), use is made of ones of the contact-charging type. Each of the charging devices has an electrically conductive roller formed into a roller shape. This charging roller is brought into contact with the surface of each of the photosensitive drums. By a charging bias voltage being applied to the charging roller, the surface of each of the photosensitive drums is uniformly charged. In the present embodiment, a discharged area developing system is used and therefore, the surface of each of the photosensitive drums is charged to the negative polarity.

The scanner units (3*a*, 3*b*, 3*c*, 3*d*) are disposed substantially in the horizontal direction of the respective photosensitive drums (1*a*, 1*b*, 1*c*, 1*d*) of the process cartridges 7 mounted on the cartridge mounting portions (30*a*, 30*b*, 30*c*, 30*d*). The scanner units (3*a*, 3*b*, 3*c*, 3*d*) apply image light corresponding to an image signal to polygon mirrors (9*a*, 9*b*, 9*c*, 9*d*) rotated by a scanner motor (not shown), by laser diodes (not shown). The image light reflected by the polygon mirrors (9*a*, 9*b*, 9*c*, 9*d*) selectively exposes the charged surfaces of the photosensitive drums (1*a*, 1*b*, 1*c*, 1*d*) thereto through imaging lenses (10*a*, 10*b*, 10*c*, 10*d*). As a result, electrostatic latent images corresponding to respective colors are formed on the photosensitive drums.

The developing devices (4*a*, 4*b*, 4*c*, 4*d*) have developer containing portions (8*a*, 8*b*, 8*c*, 8*d*) containing yellow, magenta, cyan and black developers therein. The developing devices cause the developers of the respective colors to adhere to the electrostatic latent images formed on the corresponding photosensitive drums (1*a*, 1*b*, 1*c*, 1*d*) to thereby develop those electrostatic latent images as developer images. The yellow developer is contained in the developer containing portion 8*a* of the cartridge 7*a*, and likewise, the magenta developer, the cyan developer and the black developer are contained in the developer containing portion 8*b* of the cartridge 7*b*, the developer containing portion 8*c* of the cartridge 7*c* and the developer containing portion 8*d* of the cartridge 7*d*. respectively.

The cleaning devices (6*a*, 6*b*, 6*c*, 6*d*) are for scraping off and removing any residual developers remaining on the photosensitive drums (1*a*, 1*b*, 1*c*, 1*d*) after the developer images formed thereon are transferred to the recording medium S by the electrostatic transfer device 5. The photosensitive drums (1*a*, 1*b*, 1*c*, 1*d*) cleaned by the cleaning devices (6*a*, 6*b*, 6*c*, 6*d*) become capable of effecting the next image-forming process again.

The electrostatic transfer device 5 has an electrostatic transport belt 11 for electrostatically attracting and transporting the recording medium S so as to bring the recording medium S into contact with the plurality of photosensitive drums (1*a*, 1*b*, 1*c*, 1*d*) It also has transfer rollers (12*a*, 12*b*, 12*c*, 12*d*) disposed at locations opposed to the respective photosensitive drums (1*a*, 1*b*, 1*c*, 1*d*) to transfer the developer images formed on the photosensitive drums to the recording medium S.

As the electrostatic transport belt 11, use is made of a multi-layer film-like member comprising resin film or a rubber base layer and a resin layer provided thereon. The electrostatic transport belt 11 is moved round so as to contact all of the photosensitive drums 1 (1*a*, 1*b*, 1*c*, 1*d*). In the present embodiment, the electrostatic transport belt 11 is a belt having a circumferential length of about 700 mm and a thickness of about 150 $\mu$m, and is passed over a drive roller 13, driven rollers 14*a*, 14*b* and a tension roller 15. The electrostatic transport belt 11 is rotatably driven (in the direction indicated by the arrow in FIG. 1) by the driving force of the drive roller 13. Also, an electrostatic attraction roller 22 is disposed at a region opposed to the driven roller 14*a* at the lower end. This attraction roller 22 is urged against the outer periphery of the electrostatic transport belt 11 so as to sandwich the recording medium S between itself and the electrostatic transport belt 11. A voltage is applied to between the electrostatic transport belt 11 and the attraction roller 22. As a result, charges are induced in the dielectric material layers of the recording medium S, which is a dielectric material and the electrostatic transport belt 11, and the recording medium S is electrostatically attracted to the outer periphery of the electrostatic transport belt 11.

Also, the transfer rollers (12*a*, 12*b*, 12*c*, 12*d*) are disposed at locations opposed to the photosensitive drums (1*a*, 1*b*, 1*c*, 1*d*) and contact with the inner side of the electrostatic transport belt 11. A bias voltage of the positive polarity is applied to these transfer rollers (12*a*, 12*b*, 12*c*, 12*d*) during transfer, and charges of the positive polarity are applied to the recording medium S through the electrostatic transport belt 11. By an electric field created at this time, the developer images of the negative polarity on the photosensitive drums 1 are transferred to the recording medium S which is in contact with the photosensitive drums 1.

In the transfer device 5 constructed as described above, the electrostatic transport belt 11 attracts the recording medium S to the left outer peripheral surface thereof as viewed in FIG. 1 by the attraction roller 22. The electrostatic transport belt 11 is moved round to bring the recording medium S into contact with the respective photosensitive drums (1*a*, 1*b*, 1*c*, 1*d*). By the action of the transfer rollers (12*a*, 12*b*, 12*c*, 12*d*) opposed to the photosensitive drums (1*a*, 1*b*, 1*c*, 1*d*), the developer images on the respective photosensitive drums (1*a*, 1*b*, 1*c*, 1*d*) are transferred to the recording medium S while it is transported from the roller 14*a* side to the roller 13 side.

A feeding portion 16 transports the recording medium S to the image forming portion. A cassette 17 contains a plurality of recording mediums S therein. A feed roller 18 and a pair of registration rollers 19 are rotatably driven in conformity with the image forming operation. Thereby, during image formation, the recording media S in the cassette 17 are separated and fed one by one. The leading edge of each recording medium S hits against the pair of registration rollers 19 and is once stopped thereby, and forms a loop. Thereafter, the pair of registration rollers 19 are rotated with the rotation of the electrostatic transport belt 11 synchronized with the image writing start position. The recording medium S is then fed to the electrostatic transport belt 11.

A fixing portion 20 fixes the developer images of plural colors transferred to the recording medium S on the recording medium S. It has a rotatable heat roller 21*a* and a pressure roller 21*b* urged against it and imparting heat and pressure to the recording medium S. That is, the recording medium S to which the developer images on the photosensitive drums 1 have been transferred is transported by the pair of fixing rollers (21*a*, 21*b*) and is given heat and pressure by the pair of fixing rollers when it passes through the fixing portion 20. As a result, the developer images of plural colors are fixed on the surface of the recording medium S.

The image forming process by the image forming apparatus of the present invention will be further described with reference to FIG. 1. The process cartridges 7 (7*a*, 7*b*, 7*c*, 7*d*) mounted on the respective cartridge mounting portions (30*a*, 30*b*, 30*c*, 30*d*) of the main body 25 of the apparatus are successively driven in timed relationship with image formation. In conformity with the driving, the photosensitive drums (1*a*, 1*b*, 1*c*, 1*d*) are rotatably driven in the counterclockwise direction. The scanner units (3*a*, 3*b*, 3*c*, 3*d*) corresponding to the respective cartridges 7 (7*a*, 7*b*, 7*c*, 7*d*) are successively driven. By this driving, the charging devices (2*a*, 2*b*, 2*c*, 2*d*) impart uniform charges to the peripheral surfaces of the photosensitive drums (1*a*, 1*b*, 1*c*, 1*d*). The scanner units (3*a*, 3*b*, 3*c*, 3*d*) effect exposure on the peripheral surfaces of the photosensitive drums (1*a*, 1*b*, 1*c*, 1*d*) in conformity with an image signal. As a result, electrostatic latent images of respective colors are formed on the peripheral surfaces of the photosensitive drums (1*a*, 1*b*, 1*c*, 1*d*). The developing rollers of the developing devices (4*a*, 4*b*, 4*c*, 4*d*) supply the developers contained in the developer containing portions (8*a*, 8*b*, 8*c*, 8*d*) and cause the developers to shift to the low potential portions of the electrostatic latent images. As a result, developer images are formed on the peripheral surfaces of the photosensitive drums (1*a*, 1*b*, 1*c*, 1*d*). That is, the electrostatic latent images formed on the photosensitive drums (1*a*, 1*b*, 1*c*, 1*d*) are developed.

The pair of registration rollers 19 start to be rotated in accordance with the timing at which the leading edge of the developer image on the peripheral surface of the most upstream photosensitive drum 1*a* is rotatably transported to a point opposed to the electrostatic transport belt 11 so that the image-formation starting position of the recording medium S may coincide with the opposed point. They feed the recording medium S to the electrostatic transport belt 11.

The recording medium S is urged against the outer periphery of the electrostatic transport belt 11 by the attraction roller 22 and the electrostatic transport belt 11. A voltage is then applied to between the electrostatic transport belt 11 and the attraction roller 22. Thereby, the recording medium S is electrostatically attracted to the outer periphery of the electrostatic transport belt 11. The recording medium S is stably attracted to the electrostatic transport belt 11 and is transported to the most downstream transfer portion.

As described above, the recording medium S is transported by the electrostatic transport belt 11, and in this transporting process, the developer images of respective colors formed on the photosensitive drums 1*a*, 1*b*, 1*c*, 1*d* are successively transferred to the recording medium S by electric fields formed between the corresponding photosensitive drums 1*a*, 1*b*, 1*c*, 1*d* and transfer rollers 12*a*, 12*b*, 12*c*, 12*d*.

The recording medium S to which the developer images of respective colors have been transferred is self-stripped from the electrostatic transport belt 11 by the curvature of the belt drive roller 13. Thereafter, it is carried into the fixing portion 20. The recording medium S has the developer images thereon heat-fixed by the heat roller 21*a* and the pressure roller 21*b* in the fixing portion 20. Thereafter, the recording medium S is delivered from a delivery portion 24 to the outside of the main body of the apparatus by a pair of delivery rollers 23 with its image bearing surface facing downward.

On the other hand, any untransferred residual developer on the surfaces of the photosensitive drums (1*a*, 1*b*, 1*c*, 1*d*) is scraped off by the respective cleaning devices (6*a*, 6*b*, 6*c*, 6*d*). The thus cleaned photosensitive drums (1*a*, 1*b*, 1*c*, 1*d*) again become capable of carrying out the next image forming process.

A description will now be provided of the construction of the cartridge mounting portions of the main body of the apparatus and a method of mounting and dismounting the cartridges with respect to the cartridge mounting portions.

The process cartridges 7 (7*a*, 7*b*, 7*c*, 7*d*) are designed to be interchanged with new ones after a predetermined amount of image formation with the service lives of the photosensitive drums 1 and the respective process means, such as the charging devices, the developing devices and the cleaning devices and the amounts of developers contained in the developer containing portions, taken into account. When, depending on the service life of each process means and the consumption of each developer, the interchange of each cartridge is required or a new cartridge is to be mounted on the main body of the apparatus, each process cartridge is mounted to or dismounted from the cartridge mounting portion of the main body 25 of the apparatus in a direction perpendicular to the axial direction of each photosensitive drum 1.

Figure 2:
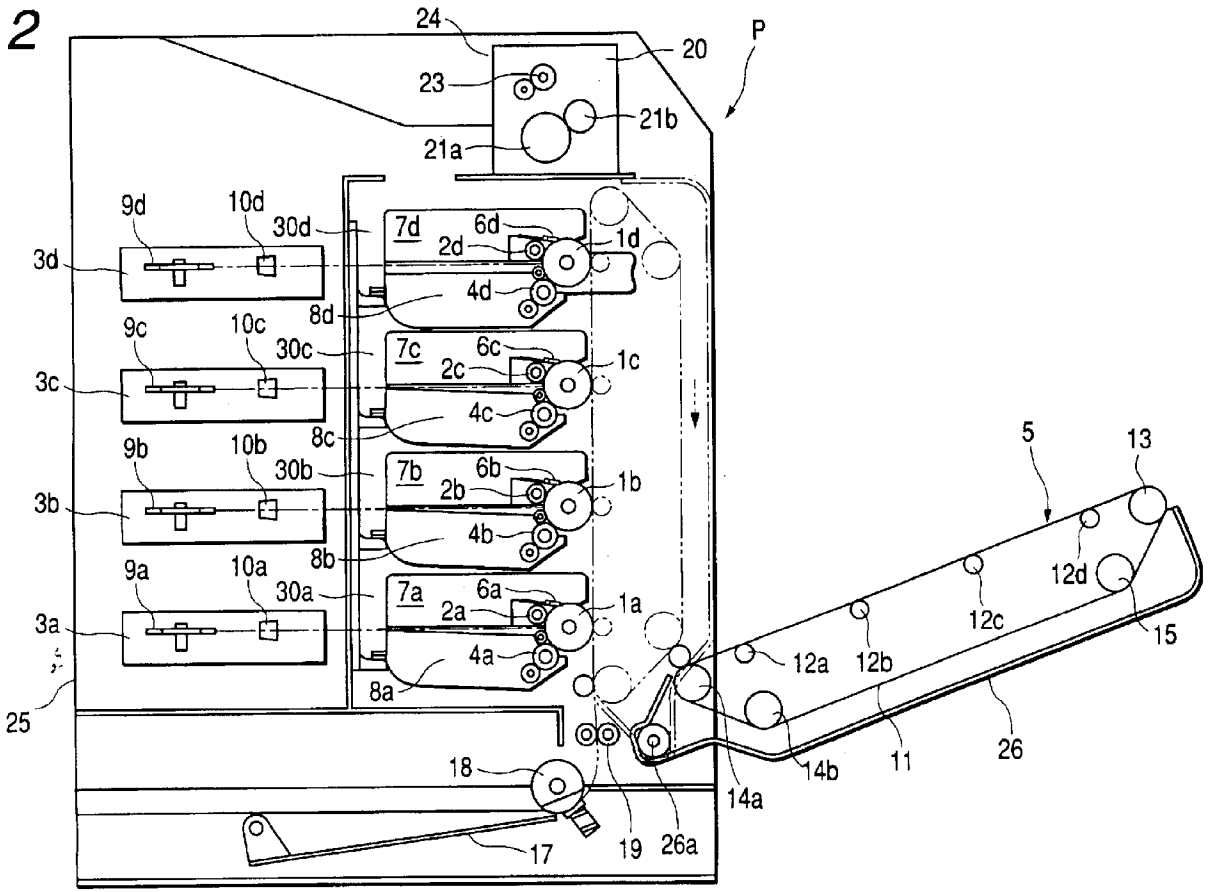
FIG. 2 is a cross-sectional view showing the general construction of the full-color laser beam printer which is an embodiment of the image forming apparatus of the present invention in a state in which the front door thereof is opened.
Figure 3:
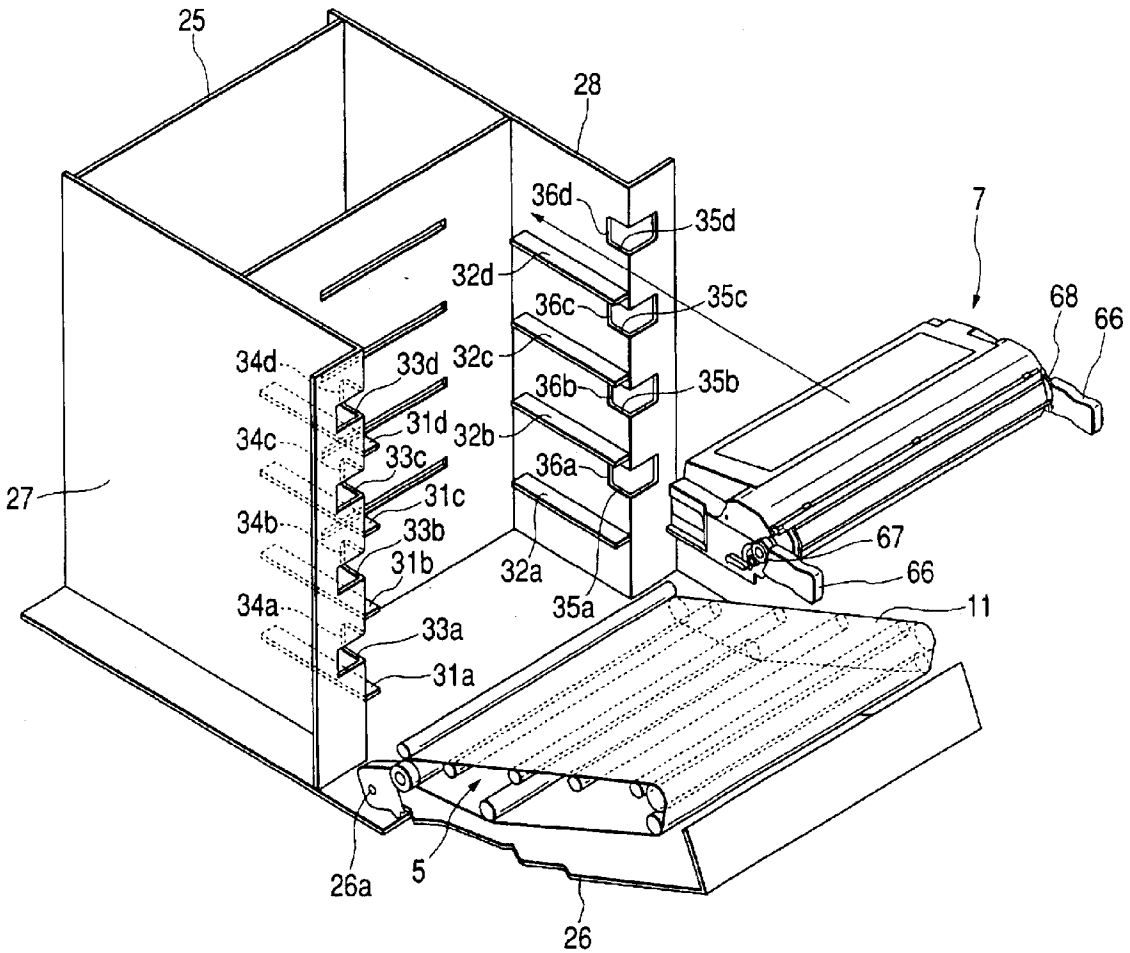
FIG. 3 is a perspective view showing the relation between the main body of the apparatus and the front door and the relation between a cartridge mounting portion and a process cartridge, in an embodiment of the image forming apparatus of the present invention.

The main body 25 of the apparatus, as shown in FIGS. 1 to 3, is provided with an insertion port having a width greater than the width of the cartridge 7 in the lengthwise direction thereof (the lengthwise direction of the photosensitive drum), and is provided therein with a plurality of (in FIG. 1, four) cartridge mounting portions (30*a*, 30*b*, 30*c*, 30*d*). A front door (openable and closable door) 26 is mounted in the insertion port of the main body 25 of the apparatus so as to be openable and closable about a rotary shaft 26*a* relative to the main body 25 of the apparatus. The front door 26 is provided with the electrostatic transport belt 11 and the transfer rollers (12*a*, 12*b*, 12*c*, 12*d*) of the electrostatic transfer device 5, and the rollers 13 to 15 for supporting the electrostatic transport belt 11. The front door 26 is usually closed as shown in FIG. 1, and is opened by an operator as shown in FIG. 2 in case of the new mounting or interchange of the cartridges 7. Simultaneously with the opening of the front door 26, the electrostatic transfer device 5 is also moved and the cartridge mounting portions (30*a*, 30*b*, 30*c*, 30*d*) are opened.

As shown in FIG. 3, first main body guide portions (31*a*, 31*b*, 30*c*, 30*d*) and second main body guide portions (32*a*, 32*b*, 32*c*, 32*d*) for guiding the cartridges 7 to the cartridge mounting portions are provided in juxtaposed relationship at equal intervals on a first side plate 27 and a second side plate 28, respectively, of the main body 25 of the apparatus. Also, at the regions of the first side plate 27 which correspond to the respective cartridge mounting portions, there are provided dash surfaces (33*a*, 33*b*, 33*c*, 33*d*) and (34*a*, 34*b*, 34*c*, 34*d*) abutting against the outer peripheral surfaces of bearings 67 rotatably supporting the photosensitive drums of the cartridges 7 and protruding outwardly from the sides thereof. At the regions of the second side plate 28 which correspond to the respective cartridge mounting portions, there are provided dash surfaces (35*a*,. 35*b*, 35*c*, 35*d*) and (36*a*, 36*b*, 36*c*, 36*d*) abutting against the outer peripheral surfaces of bearings 68 rotatably supporting the photosensitive drums 1 of the cartridges 7 and protruding outwardly from the side thereof. As a result, the cartridges 7 are positioned with respect to the respective cartridge mounting portions through the bearings 67 and 68 rotatably supporting the photosensitive drums 1. Resilient members (not shown) such as pressure springs for pressing the cartridges 7 against predetermined positions are disposed on the respective cartridge mounting portions. The cartridges are also pressed against one side plate to position the photosensitive drums 1.

The process cartridges 7 (7*a*, 7*b*, 7*c*, 7*d*), as shown in FIG. 3 (and FIG. 4), are provided with grip portions 66 protruding to the side opposite to the mounting direction of the cartridges 7 on the opposite end portions thereof in the widthwise direction of the cartridge frames thereof (the lengthwise direction of the photosensitive drums). When mounting the cartridge 7 on the cartridge mounting portion of the main body 25 of the apparatus, the operator grasps the grip portions 66 by his hands, and inserts the cartridge 7 horizontally along the main body guide portions and (FIG. 3) provided on the opposite side plates 27 and 28 of the main body,25 of the apparatus, with the photosensitive drum (in FIG. 4, 5) disposed on this side. Then, the operator causes the bearings 67 and 68 rotatably supporting the photosensitive drum 1 of the cartridge 7 to abut against the dash surfaces (33*a*, 33*b*, 33*c*, 33*d*, 34*a*, 34*b*, 34*c*, 34*d*, 35*a*, 35*b*, 35*c*, 35*d*, 36*a*, 36*b*, 36*c*, 36*d*) respectively, and ram them against these dash surfaces. Thereby, the cartridge 7 is positioned and mounted on each cartridge mounting portion of the main body 25 of the apparatus. After the cartridge 7 has been mounted on the cartridge mounting portion, the operator closes the front door 26. Thereby, the cartridge 7 is set at a predetermined position by the pressing of the resilient member such as a pressure spring, not shown. At the same time, as shown in FIG. 1, the electrostatic transport belt 11 of the electrostatic transfer device 5 provided on the front door 26 comes into contact with the photosensitive drum 1 of each cartridge 7.

The construction of the process cartridges and a shutter member as a protective member for protecting the photosensitive drum will now be described in detail with reference to FIGS. 4 to 7.

Figure 4:
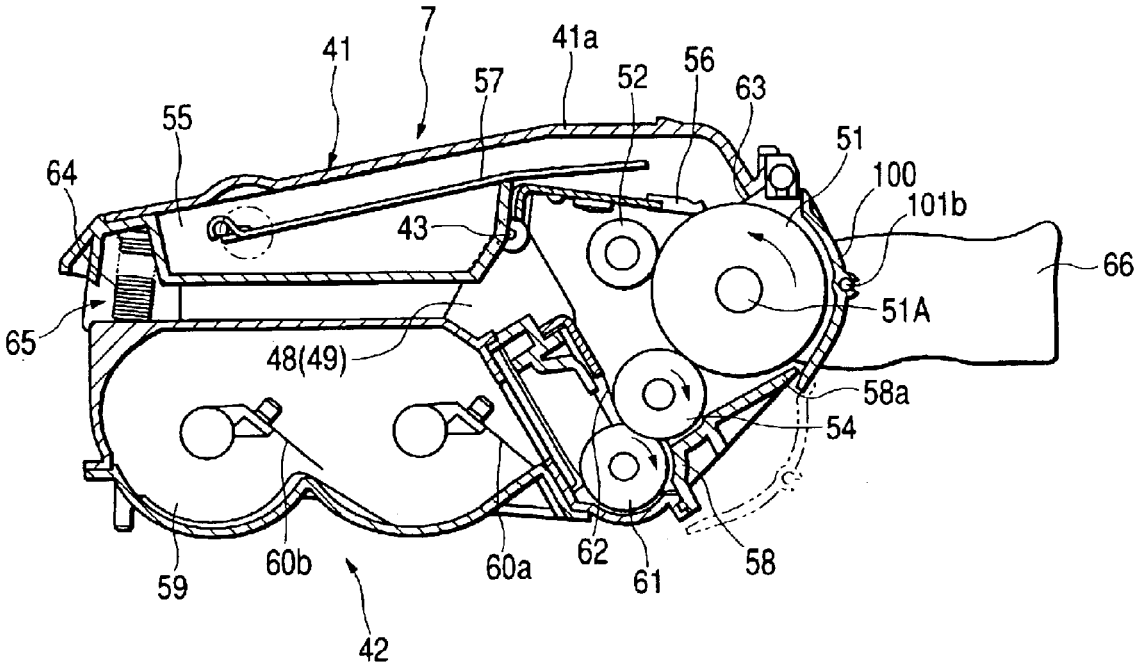
FIG. 4 is a cross-sectional view showing the construction of an embodiment of the process cartridge of the present invention.

The cartridge 7 of the present embodiment, as shown in FIG. 4, has a drum unit 41 as an upper unit (a first frame) and a developing unit 42 as a lower unit (a second frame). The two units 41 and 42 are pivotally coupled together by a rocking movement center 43, as will be described later.

The photosensitive drum 51 (corresponding to the photosensitive drum in FIG. 1) is rotatably supported on the upper unit (drum unit) 41 at the opposite side walls of the frame 41*a* of the upper unit 41. The drum shaft 51A of the photosensitive drum 51 is rotatably journalled through bearings 67 and 68 (one bearing 67 only being shown in FIG. 6). The upper unit 41 further has the charging member (charging roller) 52 of the charging device, the cleaning member (cleaning blade) 56 of the cleaning device, a removed developer containing portion 55 for containing therein the developer removed by the blade 56, and removed developer transporting means 57. On the photosensitive drum 51, a flexible sheet member 63 is disposed upstream of the cleaning blade 56. Any untransferred developer on the photosensitive drum 51 passes that portion of the flexible sheet member 63 which is in contact with the photosensitive drum 51 and arrives at the position of the cleaning blade 56, but the contacting condition of the flexible sheet member 63 is set so that the developer removed from the photosensitive drum 51 by the blade 56 may not leak to the outside of the frame 41*a* of the upper unit 41. Also, the removed developer transporting means 57 has a crank rotatably provided on the removed developer containing portion 55, and a removed developer transporting member 57 rotatably supported on this crank. The transporting member 57 is reciprocally moved by the crank being rotatively driven and transports the removed developer from the vicinity of the blade 56 to the removed developer containing portion 55.

The lower unit (developing unit) 42 is provided with the developing member (developing roller) 54 of the developing device, a developing frame 58 and a developer containing portion 59 (corresponding to the developer containing portion in FIG. 1) containing the developer of each color therein. The developer containing portion 59 is located below the removed developer containing portion 55. The interior of the developer containing portion 59 is provided with agitating members 60*a* and 60*b* serving also as a developer feeding mechanism. The developer in the developer containing portion 59 is fed to a developer supply roller 61 in the developing frame 58 while being agitated by the agitating members 60*a* and 60*b*. The developer adheres to the outer periphery of the developing roller 54 by a developing blade 62 abutting against the developer supply roller 61 rotated in the direction indicated by the arrow and the outer periphery of the developing roller 54 rotated in the direction indicated by the arrow, and charges are imparted thereto.

Also, bearing members 48 and 49 to be coupled to the upper unit 41 are provided on the opposite walls of the frame of the lower unit 42 (the lengthwisely opposite ends of the developing roller 54). The bearing members 48 and 49 have through-holes coaxially with the rocking movement center 43, and positioning pins are fitted into these through-holes and holes formed in the upper unit 41. Thereby, the upper unit 41 and the lower unit 42 are rockably coupled together through the rocking movement center 43.

Also, by the resilient forces of pressure springs 64 disposed on the lengthwisely opposite end portions of the photosensitive drum 51 which are the end portions of the two units 41 and 42 opposite to the photosensitive drum 51, the two units 41 and 42 are biased so that the developing roller 54 may be pressed against the photosensitive drum 51 about the rocking movement center 43. Thereby, the photosensitive drum 51 and the developing roller 54 reliably contact each other over the entire lengthwise area thereof. In FIG. 4, the reference numeral 65 designates an exposure opening portion formed between the upper unit 41 and the lower unit 42, and the photosensitive drum 51 is exposed to an optical image applied from the scanner unit 3 through this exposure opening portion 65 to thereby form an electrostatic latent image on the photosensitive drum 51.

When the electrostatic latent image is to be developed by the use of the process cartridge, the developer contained in the developer containing portion 59 is fed to the developer supply roller 61 in the developing frame 58 while being agitated by the agitating members 60*a* and 60*b*. The developer supply roller 61 rotated in the direction indicated by the arrow supplies the developer to the developing roller 54 by the rubbing thereof against the developing roller 54 rotated in the direction indicated by the arrow and causes the developer to be borne on the developing roller 54. The developer borne on the developing roller 54 comes to the developing blade 62 with the rotation of the developing roller 54, and the developing blade 62 regulates the developer and forms a developer layer of a predetermined thickness, and a desired amount of charge is imparted thereto. The developer made into a thin layer on the developing roller 54 is transported to a developing portion in which the photosensitive drum 51 and the developing roller 54 are in contract with each other, with the rotation of the developing roller 54 in the direction indicated by the arrow, and in the developing portion, the developer adheres to the electrostatic latent image formed on the surface of the photosensitive drum 51, by a DC developing bias applied from a power source (not shown) to the developing roller 54, thereby developing the latent image. Any residual developer on the surface of the developing roller 54 without contributing to the development of the electrostatic latent image is returned into the developing frame 58 with the rotation of the developing roller 54, and is stripped and collected from the developing roller 54 at the frictional contact portion thereof with the developer supply roller 61. The thus collected developer is agitated and mixed with the remaining developer by the agitating members 60*a* and 60*b*.

In the contact developing system of the present embodiment, in which the photosensitive drum 51 and the developing roller 54 are in contact with each other and effect development, it is preferable that the photosensitive drum 51 be a rigid member and that the surface layer of the developing roller 54 (the contact portion thereof with the photosensitive drum 51) be an elastic member. As this elastic member, use is made of a solid rubber single layer or a solid rubber layer subjected to resin coating thereon with a charge imparting property to the developer taken into account.

Now, a characteristic of the photosensitive drum 51 in the process cartridge 7 will deteriorate if exposed to external daylight for a long time, and if the photosensitive drum 51 is exposed in case of the handling thereof outside the image forming apparatus, it may be damaged or foreign substances may adhere to its surface. In order to eliminate such possibility of deterioration or damage, provision is made of a drum shutter (shutter member) 100 functioning as a protective member for opening and closing the opening portion for exposing a portion of the photosensitive drum 51 in the frame of the process cartridge 7 to thereby protect the photosensitive drum, and when the process cartridge 7 is mounted on the cartridge mounting portion of the main body 25 of the apparatus, the drum shutter 100 is opened and exposes the photosensitive drum 51, but the drum shutter 100 is designed to be closed in the other cases.

Figure 5:
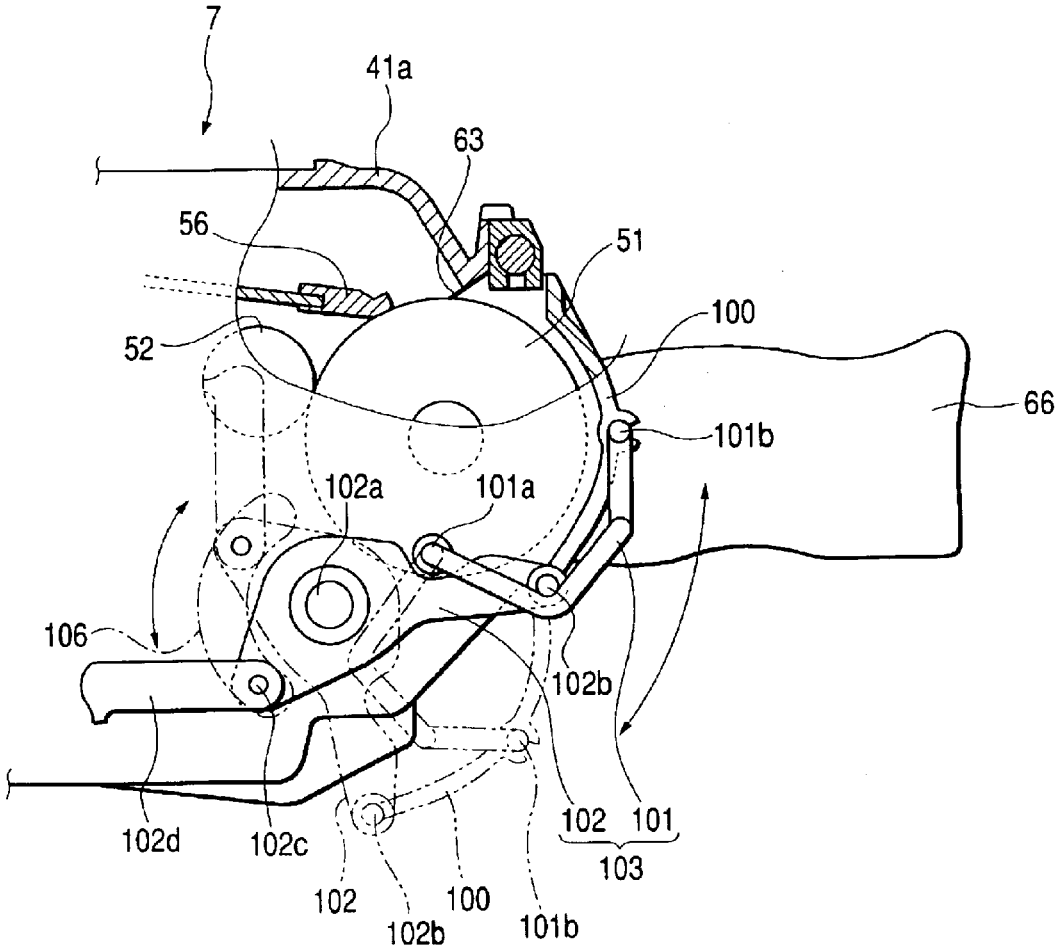
FIG. 5 is an illustration showing a drum shutter and a shutter opening and closing link mechanism in an embodiment of the process cartridge of the present invention on an enlarged scale.
Figure 6:
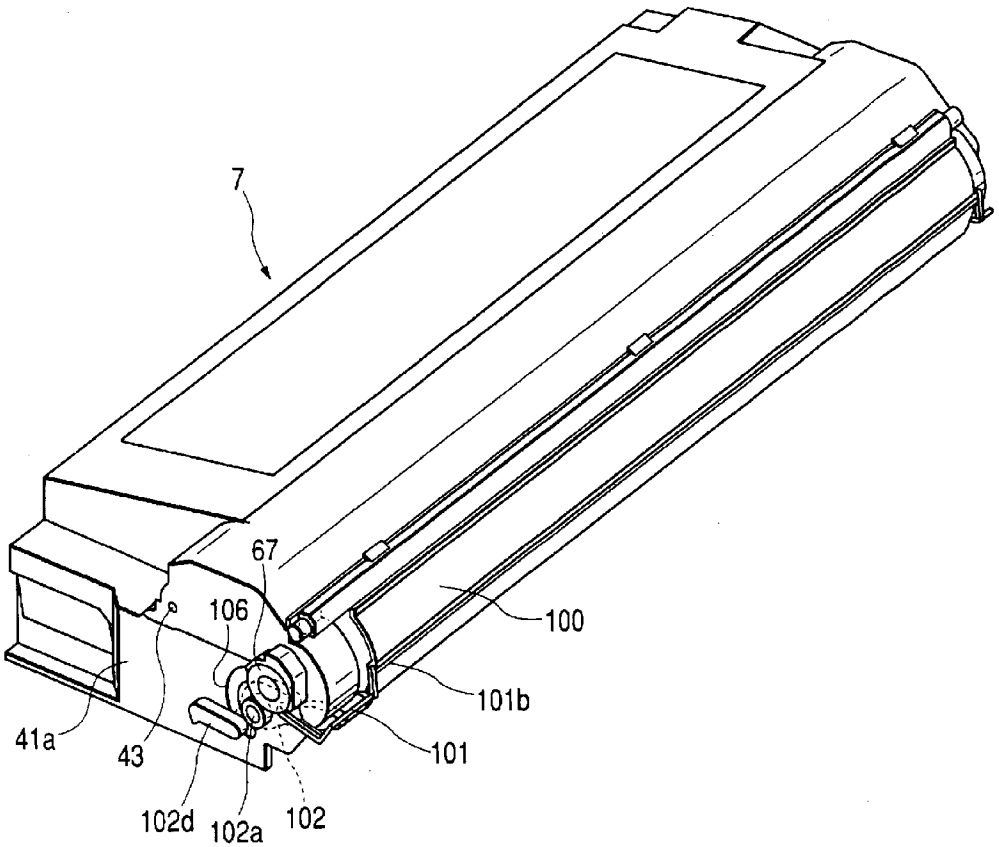
FIG. 6 is a schematic perspective view showing a state in which in an embodiment of the process cartridge of the present invention, the drum shutter is in a protection position.
Figure 7:
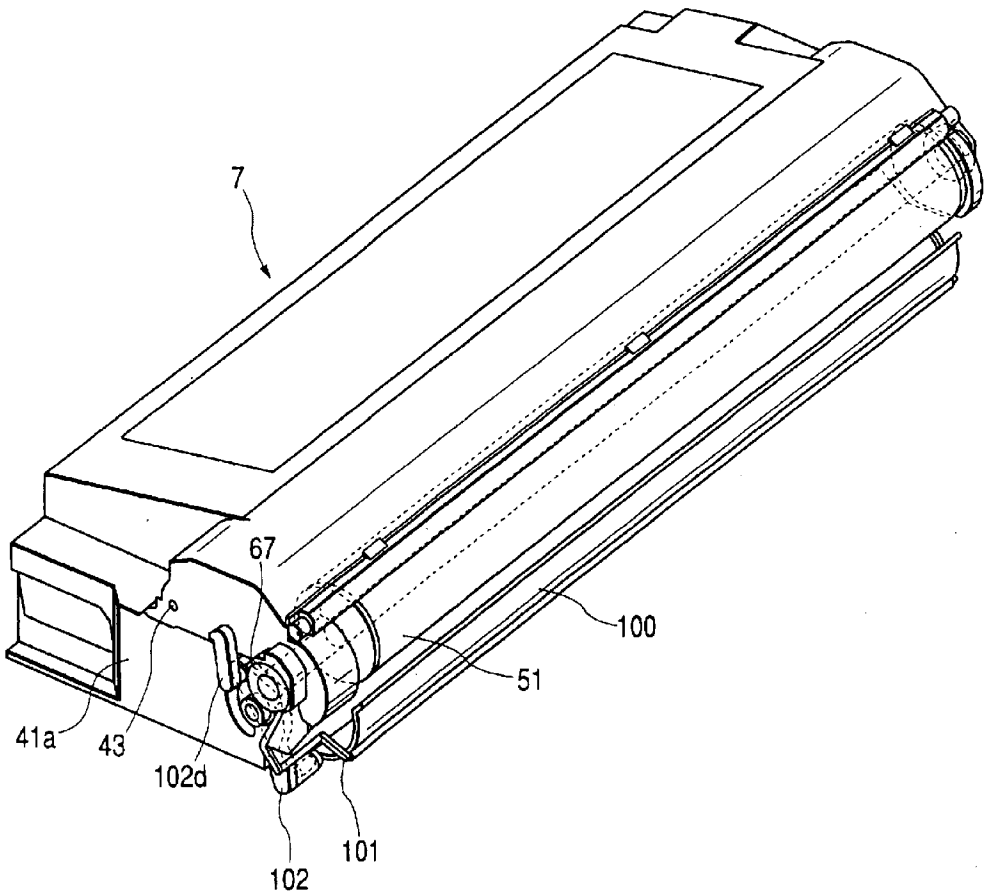
FIG. 7 is a schematic perspective view showing a state in which in an embodiment of the process cartridge of the present invention, the drum shutter is moved to a retraction position and a photosensitive drum is opened.

As shown in FIGS. 4 and 5, in the frame opening portion from the distal end portion 58*a* of the developing frame to the contact portion of the flexible sheet member 63 in the frame of the process cartridge 7, there is disposed the drum shutter 100 which is retractable to a position in which it does not hinder the transfer of the developer image to the recording medium during image formation. That is, the drum shutter 100 is provided for movement between a protection position (shielding position) in which it shields the opening portion of the cartridge frame for exposing a portion of the photosensitive drum 51 therethrough and protects the exposed portion of the photosensitive drum 51 (a position indicated by solid line in FIGS. 4 and 5) and a retraction position in which it is retracted from the protection position and opens the opening portion (a position indicated by double-dotted line in FIGS. 4 and 5).

The drum shutter 100, as shown in FIG. 5, is movably mounted through a shutter opening and closing link mechanism 103 comprising a shutter shaft member 101 and a shutter opening and closing arm 102 pivotably supported on the frame of the cartridge 7 (the side wall surface of the frame 41*a* of the upper unit 41). The shutter shaft member 101 of the shutter opening and closing link mechanism 103 which comprises a substantially U-shaped metal bar or the like has its opposite end portions 110*a* rotatably journalled to the right and left side wall surfaces of the frame 41*a* of the cartridge 7, and its central portion 101*b* is rotatably mounted on the vertically central portion of the drum shutter 100 along the widthwise direction thereof. The shutter opening and closing arm 102 is a transmitting member for performing the opening and closing operation of the drum shutter 100 in operative association with the opening and closing operation of the front door (openable and closable door) 26 of the main body 25 of the apparatus which will be described later, and is rotatably supported by a rotary shaft 102*a* disposed on the left wall surface of the frame 41*a* of the cartridge 7, and one end portion 102*b* thereof is rotatably mounted on the lower end portion of the drum shutter 100, and on the other end portion thereof, a convex member 102*c* is provided while leftwardly protruding through an arcuate groove 106. This convex member 102*c* is provided with an abutting portion 102*d* abutting against a shutter interlocking plate 111 (see FIGS. 8 to 10) operatively associated with the opening and closing operation of the front door 26 of the main body 25 of the apparatus. It is preferable that at least the abutting portion 102*d* protrudes from the side wall surface of the frame 41*a* of the cartridge 7 through the arcuate groove 106. Also, the shutter opening and closing arm 102 of the shutter opening and closing link mechanism 103 is biased in a counterclockwise direction by a shutter spring (not shown) so as to maintain the protection position indicated by solid line in FIG. 5. Accordingly, in a state in which no force is applied to the convex member 102*c* and the abutting portion 102*d* of the shutter opening and closing arm 102, such as a state in which the cartridge 7 has been taken out of the main body 25 of the apparatus, the drum shutter 100 is positioned in the protection position indicated by solid line in FIGS. 4 and 5, by the biasing force of the shutter spring (not shown). The shutter opening and closing arm 102 then performs the opening and closing operation of the drum shutter 100 in operative association with the vertical movement of the shutter interlocking plate 111, which will be described later.

Figure 8:
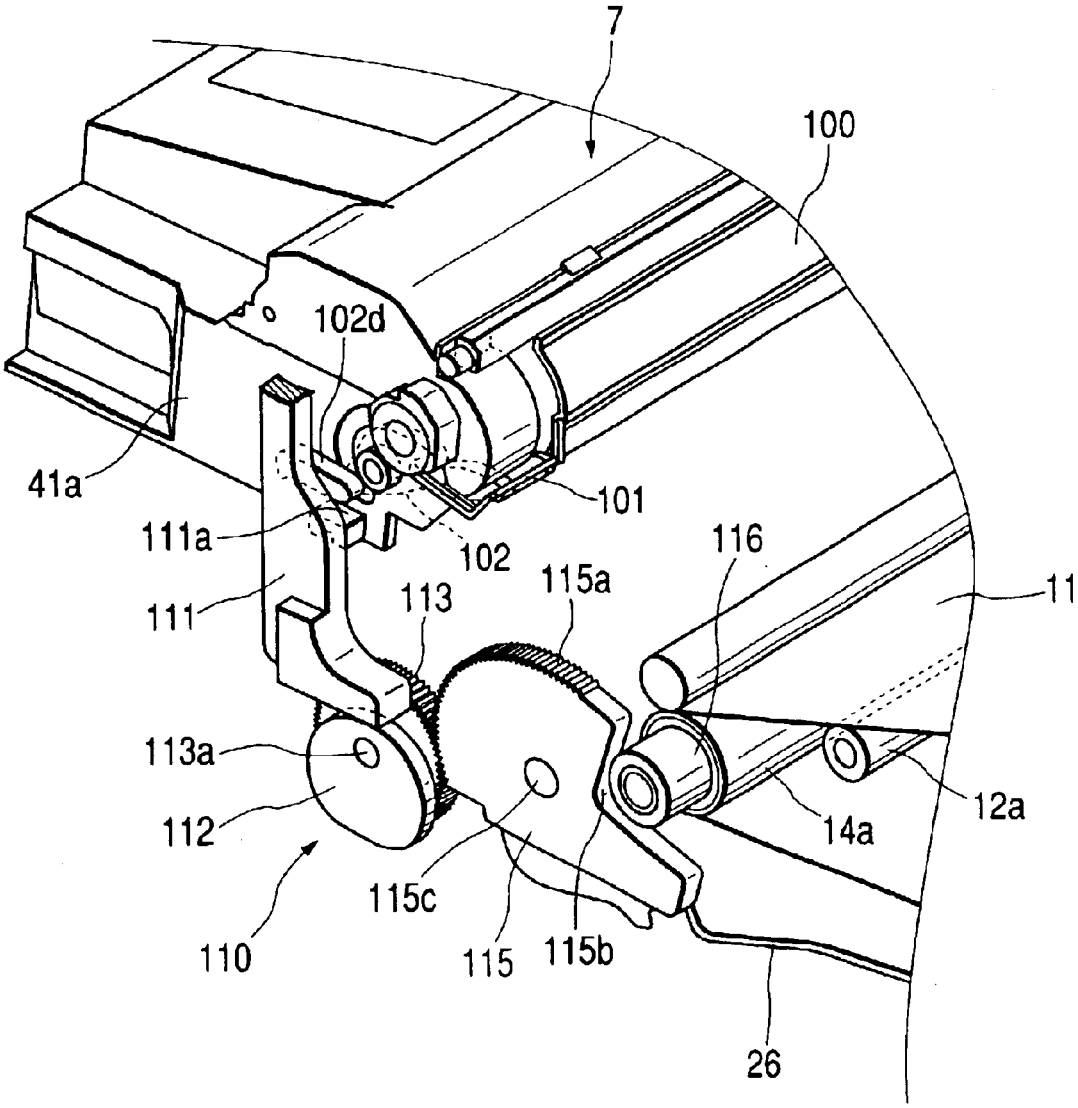
FIG. 8 is a perspective view showing, in an embodiment of an image forming apparatus according to the present invention, the relation between a shutter opening and closing mechanism on the main body side of the apparatus and the drum shutter of the process cartridge in a state in which a front door is opened.
Figure 9:
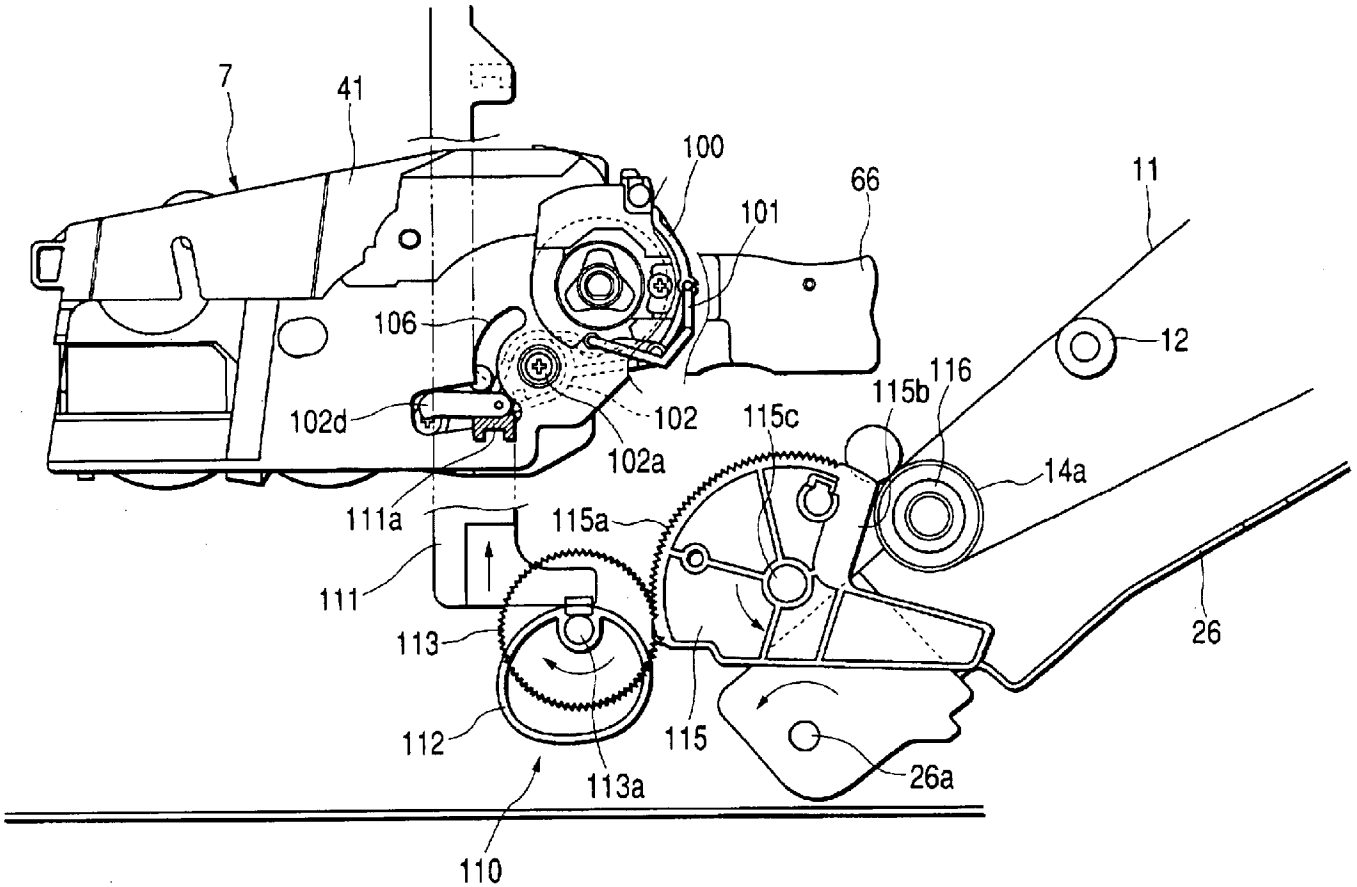
FIG. 9 is a side view showing, in an embodiment of the image forming apparatus according to the present invention, the relation between the shutter opening and closing mechanism on the main body side of the apparatus in a state in which the front door is opened and the drum shutter of the process cartridge.
Figure 10:
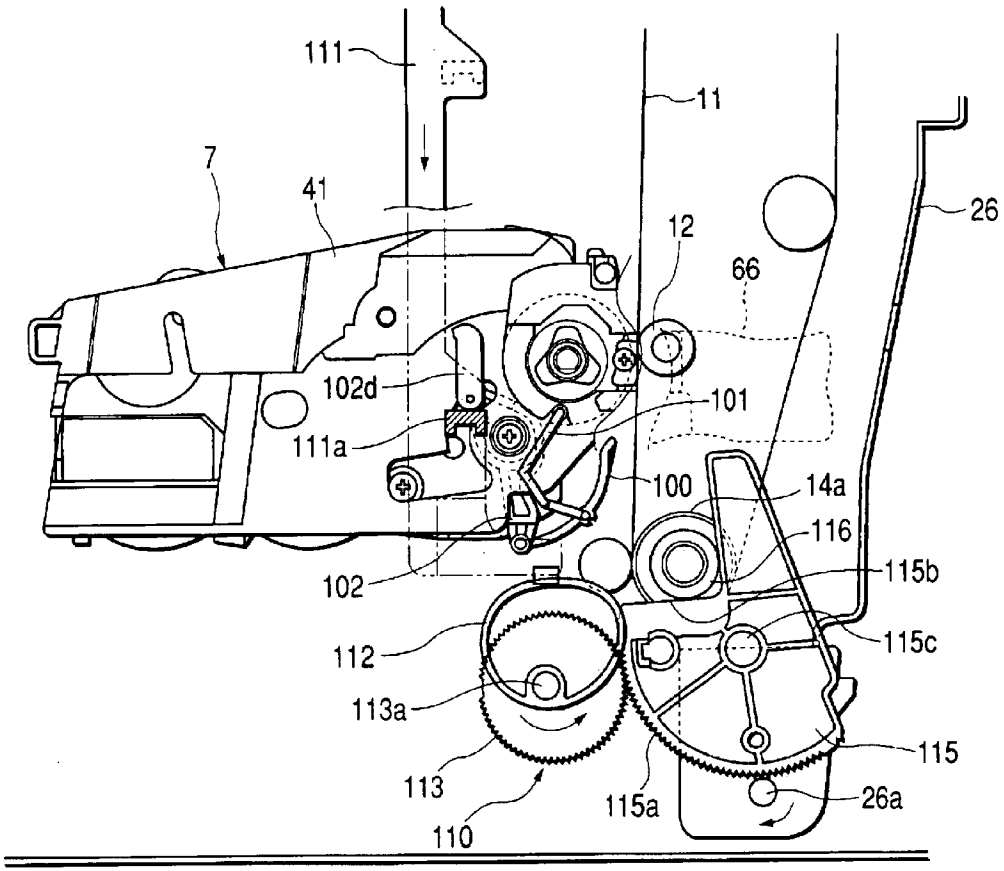
FIG. 10 is a side view showing, in an embodiment of the image forming apparatus according to the present invention, the relation between the shutter opening and closing mechanism on the main body side of the apparatus in a state in which the front door is closed and the drum shutter of the process cartridge.

On the main body 25 side of the image forming apparatus P, as shown in FIGS. 8 to 10, there is provided a (main body side) shutter opening and closing mechanism 110 for vertically moving the shutter interlocking plate 111 for performing the opening and closing operation of the drum shutter 100 of each cartridge 7 in operative association with the opening and closing operation of the front door 26 of the main body 25 of the apparatus. The shutter opening and closing mechanism 110 is disposed on the inner surface side of the side wall 27 of the main body 25 of the apparatus, and is comprised of the shutter interlocking plate 111 extending substantially vertically along each cartridge mounting portion 30 and disposed for movement in the vertical direction, a cam member 112 against which the lower end portion of the shutter interlocking portion 111 abuts a cam gear 113 provided integrally with the cam member 112, and a rotary member 115 having a gear portion 115*a* meshing with the cam gear 113 and a pressed portion 115*b* engaged with the pressed by a pressing portion 116 provided on the front door 26, and disposed for rotation about a rotary shaft 115*c*. In the present embodiment, the pressing portion 116 provided on the front door 26 is provided by the circumferential portion of the shaft portion of the driven roller 14*a* of the electrostatic transport belt 11 located in the lower portion of the front door 26 being protruded toward a side. Also, the shutter interlocking portion 111 is provided with a projected portion 111*a* for abutting against and vertically moving the abutting portion 102*d* of the shutter opening and closing arm 102 of the cartridge in each cartridge mounting portion.

The relation between the opening and closing operation of the front door of the main body of the apparatus and the movement of the drum shutter will now be described with reference to FIGS. 8 to 10.

In case of the new mounting or interchange of the cartridge 7, the front door 26 of the main body 25 of the apparatus is opened and the cartridge 7 is inserted into and mounted on a predetermined cartridge mounting portion. Thereafter, the front door 26 is closed. The state in which the cartridge 7 is mounted on the predetermined cartridge mounting portion is shown in FIGS. 8 and 9. In this state, the drum shutter 100 of the cartridge 7 is still positioned in the protection position (see also FIG. 6). In case of the closing operation of pivotally moving the front door 26 in the direction indicated by the arrow about the rotary shaft 26*a* from this state, the pressing portion 116 of the front door 26 is moved and abuts against the pressed portion 115*b* of the rotary member 115, thereby pivotally moving the rotary member 115 in the direction indicated by the arrow about the rotary shaft 115*c*. This pivotal movement of the rotary member 115 in the direction indicated by the arrow pivotally moves the gear portion 115*a* to thereby rotate the cam gear 113 meshing with the gear portion 115*a* in the direction indicated by the arrow. By this rotation of the cam gear 113, the cam member 112 is also rotated at the same time to thereby upwardly move the shutter interlocking plate 111 abutting against the cam member 112. By this upward movement of the shutter interlocking plate 111, the projected portion 111*a* is also upwardly moved to thereby push up the abutting portion 102*d* of the shutter opening and closing arm 102 against which the projected portion 111*a* is abutting. Thereby, the shutter opening and closing arm 102 is pivotally moved clockwise about the rotary shaft 102*a*, and by the downward movement of one end portion 102*b* of the shutter opening and closing arm 102, the drum shutter 100 is pivotally moved about the opposite end portions 111*a* of the shutter shaft member 101 and is moved to the retraction position shown in FIG. 10, and a portion of the photosensitive drum 51 is exposed through the opening portion (see also FIG. 7). When the front door 26 is completely closed in this manner, the drum shutter 100 is moved to the retraction position, as shown in FIG. 10. This retraction position of the drum shutter 100 is a position in which it does not hinder the image formation by the process cartridge between the cartridge frame 41*a* and the openable and closable door 26 and between adjacent cartridges. The electrostatic transport belt 11 contacts with the photosensitive drum 51 exposed through the opening portion of the cartridge frame 41*a* and the transfer roller 12 is positioned at a position corresponding to the photosensitive drum 51. In this manner, there is brought about a state in which image formation becomes possible.

Also, when the front door 26 is to be opened for the interchange or the like of the cartridge 7, the main body side shutter opening and closing mechanism 110 and the shutter opening and closing link mechanism 103 are operated conversely to the aforedescribed operation, by the opening operation of the front door 26. That is, when in FIG. 10, the front door 26 is pivotally moved in the clockwise direction about the shaft 26*a*, the rotary member 115 is pushed by the pressing member 116 and begins to be rotated in the clockwise direction about the rotary shaft 115. The cam gear 113 meshing with the gear portion 115*a* of the rotary member 115 is then rotated in the counterclockwise direction about the shaft 113*a*. Thereby, the shutter interlocking plate 111 abutting against the cam 112 is downwardly moved and the projected portion 111*a* of the shutter interlocking plate 111 releases its abutment against the abutting portion 102*d* of the shutter opening and closing arm 102 and is downwardly moved. As a result, the drum shutter 100 is moved from the retraction position indicated by dots-and-dash line in FIG. 5 to the protection position indicated by solid line in FIG. 5 by the biasing force of the shutter spring (not shown), and is returned to the protection position.

By constructing the drum shutter and the opening and closing means therefore as described above, it is possible to open and close the drum shutter in operative association with the opening and closing operation of the front door associated with the mounting and dismounting operation of the process cartridge. Further, the drum shutter is moved by the use of the shutter opening and closing link mechanism comprising the shutter shaft member and the shutter opening and closing arm rotatably coupled to the drum shutter, whereby the drum shutter can be made retractable by a simple construction and a limited space in the main body of the apparatus.

The aforedescribed embodiment of the present invention will be summarized as follows.

In the aforedescribed embodiment, it is preferable that the grips 66 to be grasped in case of mounting and dismounting the process cartridge which protrude in the mounting and dismounting direction of the process cartridge, be provided on the lengthwise opposite end portions of the electrophotographic photosensitive drum 51 and the shutter member 100 be passed between the grips 66 and moved between the protection position and the retraction position with its surface side opposed to the electrophotographic photosensitive drum 51 being opposed to the cartridge frame 41*a* and further, it is preferable that the shutter member 100 be biased by biasing means so as to be positioned in the protection position.

Also, in the embodiment of the process cartridge, it is preferable that the shutter opening and closing link mechanism 103 have a shutter shaft member 101 having its opposite end portions 101*a* pivotally supported on the opposite side portions of the cartridge frame 41*a* and having its central portion 101*b* pivotally coupled to the shutter member 100, and a shutter opening and closing arm 102 having one end portion 102*b* thereof pivotally coupled to the shutter member 100, and be designed such that the other end portion 102*c* of the shutter opening and closing arm 102 is moved to thereby pivotally move the shutter opening and closing arm 102, thereby moving the shutter member 100 between the protection position and the retraction position, and it is preferable that at least a portion of the other end portion 102*c* of the shutter opening and closing arm 102 be designed to protrude from the side wall surface of the cartridge frame 41*a* and be engaged with a main body side member moved in operative association with the opening and closing operation of the openable and closable door 26 of the main body 25 of the image forming apparatus.

Further, in the embodiment of the image forming apparatus, it is preferable that the retraction position of the shutter member 100 of the process cartridge 7 be set at a position in which between the cartridge frame 41*a* and the openable and closable door 26 and between adjacent cartridge mounting portions, it does not hinder the image formation by the process cartridge.

Also, in the embodiment of the image forming apparatus, it is preferable that the main body side shutter opening and closing mechanism 110 have a rotary member 115 having a pressed portion 115*b* against which a pressing member 116 provided on the openable and closable door 26 abuts and a gear portion 115*a*, a cam gear 113 meshing with the gear portion 115*a* of the rotary member 115, a cam member 112 provided integrally with the cam gear 113, and a shutter interlocking plate 111 abutting against the cam member 112 and substantially vertically extending along the plurality of cartridge mounting portions and disposed for movement in the vertical direction, and be designed such that the shutter interlocking plate 111 is moved up and down in conformity with the opening and closing operation of the openable and closable door 26, and further, it is preferable that the shutter opening and closing link mechanism 103 have a shutter shaft member 101 having its opposite end portions 110*a* pivotally supported on the opposite sides of the cartridge frame 41*a* and having its central portion 101*b* pivotally coupled to the shutter member 100, and a shutter opening and closing arm 102 having its central portion 102*a* pivotally supported on the cartridge frame 41*a* and having one end portion 102*b* thereof pivotally coupled to the shutter member 100, and be designed such that the other end portion 102*c* of the shutter opening and closing arm 102 is moved to thereby pivotally move the shutter opening and closing arm 102, thereby moving the shutter member 100 between the protection position and the retraction position, and it is preferable that at least a portion of the other end portion 102*c* of the shutter opening and closing arm 102 be designed to protrude from the side wall surface of the cartridge frame 41*a* and be engaged with the shutter interlocking plate 111 of the main body side shutter opening and closing link mechanism 110 moved in operative association with the opening and closing operation of the openable and closable door 26 of the main body 25 of the image forming apparatus.

According to the aforedescribed embodiment, in the process cartridge detachably mountable to the main body of the image forming apparatus, the shutter member (drum shutter) for protecting the electrophotographic photosensitive drum is designed to be moved between the protection position and the retraction position in operative association with the opening and closing operation of the openable and closable door of the main body of the image forming apparatus. Also, as the opening and closing mechanism for the shutter member, use is made of a shutter opening and closing link mechanism comprising a shutter shaft member and a shutter opening and closing arm rotatably coupled to the shutter member to thereby realize a shutter member retractable by a simple construction and a limited space in the main body of the apparatus.

As described above, according to the present embodiment, the shutter member (drum shutter) for protecting the photosensitive drum in the process cartridge detachably mountable to the main body of the image forming apparatus can be moved by the shutter opening and closing mechanism operated in operative association with the opening and closing operation of the openable and closable door of the main body of the image forming apparatus. Further, the shutter member is moved by the use of the shutter opening and closing link mechanism comprising the shutter shaft member and the shutter opening and closing arm rotatably coupled to the shutter member, whereby there can be realized a shutter member retractable by a limited space in the main body of the image forming apparatus.

As described above, according to the present invention, the shutter member can be retracted in a smaller space.

While the invention has been described with reference to the structure disclosed therein, it is not confined to the details set forth and this application is intended to cover such modifications or changes as may come within the purposes of the improvements or the scope of the following claims.

What is claimed is:

1. An image forming apparatus for forming an image on a recording medium with a plurality of process cartridges detachably mounted thereto, comprising:

a plurality of cartridge mounting portions configured and positioned to detachably mount the process cartridges each having an electrophotographic photosensitive drum, at least one process means for acting on the electrophotographic photosensitive drum, a cartridge frame holding the electrophotographic photosensitive drum and the process means, and exposing a portion of the electrophotographic photosensitive drum, a shutter member provided for movement between a protection position in which the shutter member protects an exposed portion, which is the portion of the electrophotographic photosensitive drum exposed out of the cartridge frame, and a retraction position in which the shutter member is downardly retracted from the protection position to expose the exposed portion of the electrophotographic photosensitive drum out of the cartridge frame, and a shutter opening and closing mechansim configured and positioned to move the shutter member:

an openable and closable door; and a main body side shutter opening and closing mechansim configured and positioned to operate the shutter opening and closing mechansim of each of the process cartridges mounted to the cartridge mounting portions, in operative association with opening and closing operations of said openable and closable door to thereby move the shutter member of each of the process cartridges between the protection position and the retraction position, wherein said main body side shutter opening and closing mechanism comprises:

a rotary member comprising:

a pressed portion against which a pressing member provided on said openable and closable door abuts; and a gear portion;

a cam gear meshing with said gear portion of said rotary member;

a cam member provided integrally with said cam gear; and a shutter interlocking plate abutting against said cam member while substantially vertically extending along said plurality of cartridge mounting portions and disposed for vertical movement, said shutter interlocking plate moving up and down in conformity with the opening and closing operations of said openable and closable door.

2. An image forming apparatus according to claim 1, wherein the retraction position of the shutter member of each of the process cartridges is set at a position in which the shutter member is between the cartridge frame and said openable and closable door and between adjacent cartridge mounting portions so that the shutter member does not hinder performance of an image formation operation when the process cartridges are mounted on said plurality of cartridge mounting portions.

3. An image forming apparatus according to claim 1 or 2, wherein the shutter opening and closing mechansim of each cartridge comprises:

a shutter shaft member having opposite end portions pivotally supported on opposite sides of the cartridge frame, and a central portion pivotally coupled to the shutter member; and a shutter opening and closing arm, wherein a central portion of the shutter opening and closing arm is pivotally supported on the cartridge frame, wherein one end portion of the shutter opening and closing arm is pivotally coupled to the shutter member, and wherein the other end portion of the shutter opening and closing arm is movable to thereby permit the shutter opening and closing arm to pivotally move when the other end portion of the shutter opening and closing arm is moved, thereby moving the shutter member between the protection position and the retraction position.

4. An image forming apparatus according to claim 3, wherein at least a portion of the other end portion of the shutter opening and closing arm protrudes from a side wall surface of the cartridge frame and is engageable with said shutter interlocking plate of said main body side shutter opening and closing mechanism moved in operative association with the opening and closing operations of said openable and closable door of the main body of said image forming apparatus.

* * * * *

UNITED STATES PATENT AND TRADEMARK OFFICE

CERTIFICATE OF CORRECTION

PATENT NO. : 6,968,142 B2
APPLICATION NO. : 10/367805
DATED : November 22, 2005
INVENTOR(S) : Takeshi Arimitsu et al.

It is certified that error appears in the above-identified patent and that said Letters Patent is hereby corrected as shown below:

On Title Page
At Item (56), Foreign Patent Documents, "JP 2001142378 5/2001" should read --JP 2001-142378 5/2001--.
At Item (57), Abstract, line 7, "the" (first occurrence) should be deleted.

COLUMN 5
Line 56, "7d." should read --7d,--.

COLUMN 6
Line 3, "1d)" should read --1d).--.

Signed and Sealed this

Fifteenth Day of August, 2006

JON W. DUDAS
*Director of the United States Patent and Trademark Office*